US011845267B2

(12) United States Patent
Kobayashi et al.

(10) Patent No.: US 11,845,267 B2
(45) Date of Patent: Dec. 19, 2023

(54) PRINTING DEVICE AND CONTROL METHOD FOR PRINTING DEVICE

(71) Applicant: SEIKO EPSON CORPORATION, Tokyo (JP)

(72) Inventors: Takehiro Kobayashi, Matsumoto (JP); Hitoshi Ishino, Suwa-gun Shimosuwa-machi (JP); Rikuo Yamada, Higashichikuma-gun Yamagata-mura (JP)

(73) Assignee: SEIKO EPSON CORPORATION, Tokyo (JP)

( * ) Notice: Subject to any disclaimer, the term of this patent is extended or adjusted under 35 U.S.C. 154(b) by 98 days.

(21) Appl. No.: 17/519,774

(22) Filed: Nov. 5, 2021

(65) Prior Publication Data

US 2022/0134781 A1 May 5, 2022

(30) Foreign Application Priority Data

Nov. 5, 2020 (JP) ..... 2020-185118

(51) Int. Cl.
*B41J 11/42* (2006.01)
*B41J 2/32* (2006.01)

(52) U.S. Cl.
CPC ..... *B41J 11/42* (2013.01); *B41J 2/32* (2013.01)

(58) Field of Classification Search
CPC ..... B41J 11/42; B41J 2/32; B41J 15/04; B41J 11/02; B41J 11/04; B41J 11/053; B41J 11/057; B41J 11/06; B41J 11/08; B41J 11/10; B41J 11/13
See application file for complete search history.

(56) References Cited

U.S. PATENT DOCUMENTS 5,430,468 A * 7/1995 Sasai ..... B41J 11/42 400/636
2020/0130374 A1* 4/2020 Horaguchi ..... B41J 2/36

FOREIGN PATENT DOCUMENTS

JP H08258314 A 10/1996

* cited by examiner

*Primary Examiner* — Kristal Feggins
(74) *Attorney, Agent, or Firm* — CHIP LAW GROUP

(57) ABSTRACT

A printing device includes: a printing unit printing on a recording paper; a feeder unit that has a roller rotating in a first direction about a shaft and feeding the recording paper, and a motor rotating the shaft; a detection unit detecting a rotation of the shaft in the first direction and a rotation thereof in a second direction opposite to the first direction; and a control unit controlling the feeder unit, based on the rotation of the shaft detected by the detection unit. The control unit causes the motor of the feeder unit to rotate the shaft in the first direction and then stop the shaft, and subsequently causes the motor to rotate the shaft in the first direction before the printing unit prints, based on the rotation of the shaft in the second direction detected by the detection unit.

4 Claims, 3 Drawing Sheets

PRINTING DEVICE AND CONTROL METHOD FOR PRINTING DEVICE

The present application is based on, and claims priority from JP Application Serial Number 2020-185118, filed Nov. 5, 2020, the disclosure of which is hereby incorporated by reference herein in its entirety.

BACKGROUND

1. Technical Field

The present disclosure relates to a printing device and a control method for a printing device.

2. Related Art

According to the related art, a printing device configured in such a way that a head is spaced apart from a platen, which is a roller, by a link in order to restrain the deformation of the platen during a period when the printing device is not in use, is known, as described in JP-A-2000-127552.

However, the printing device described in JP-A-2000-127552 does not take into account the deformation of the platen when the printing device is in use, and therefore has a risk of deterioration in the result of printing.

SUMMARY

A printing device includes: a printing unit printing on a recording paper; a feeder unit that has a roller rotating in a first direction about a shaft and feeding the recording paper, and a motor rotating the shaft; a detection unit detecting a rotation of the shaft in the first direction and a rotation thereof in a second direction opposite to the first direction; and a control unit controlling the feeder unit, based on the rotation of the shaft detected by the detection unit. The control unit causes the motor of the feeder unit to rotate the shaft in the first direction and then stop the shaft, and subsequently causes the motor to rotate the shaft in the first direction before the printing unit prints, based on the rotation of the shaft in the second direction detected by the detection unit.

A control method for a printing device including a printing unit printing on a recording paper, a feeder unit that has a roller rotating in a first direction about a shaft and feeding the recording paper, and a motor rotating the shaft, and a detection unit detecting a rotation of the shaft in the first direction and a rotation thereof in a second direction opposite to the first direction. The control method includes: causing the motor of the feeder unit to rotate the shaft in the first direction and then stop the shaft, and subsequently causing the motor to rotate the shaft in the first direction before the printing unit prints, based on the rotation of the shaft in the second direction detected by the detection unit.

DESCRIPTION OF EXEMPLARY EMBODIMENTS

1. Embodiment

1-1. Configuration of Printing Device 1

Figure 1:
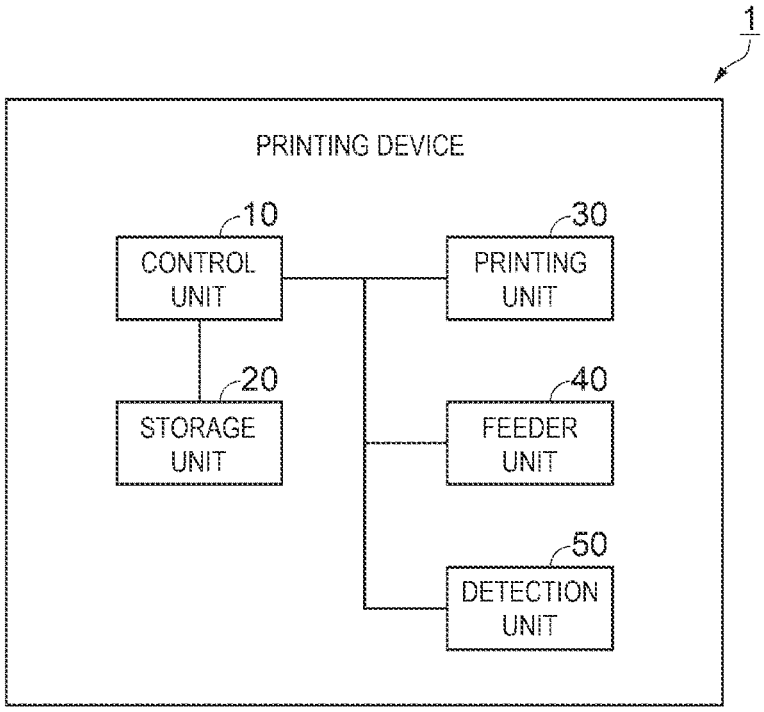
FIG. 1 is a block diagram showing the configuration of a printing device.
Figure 2:
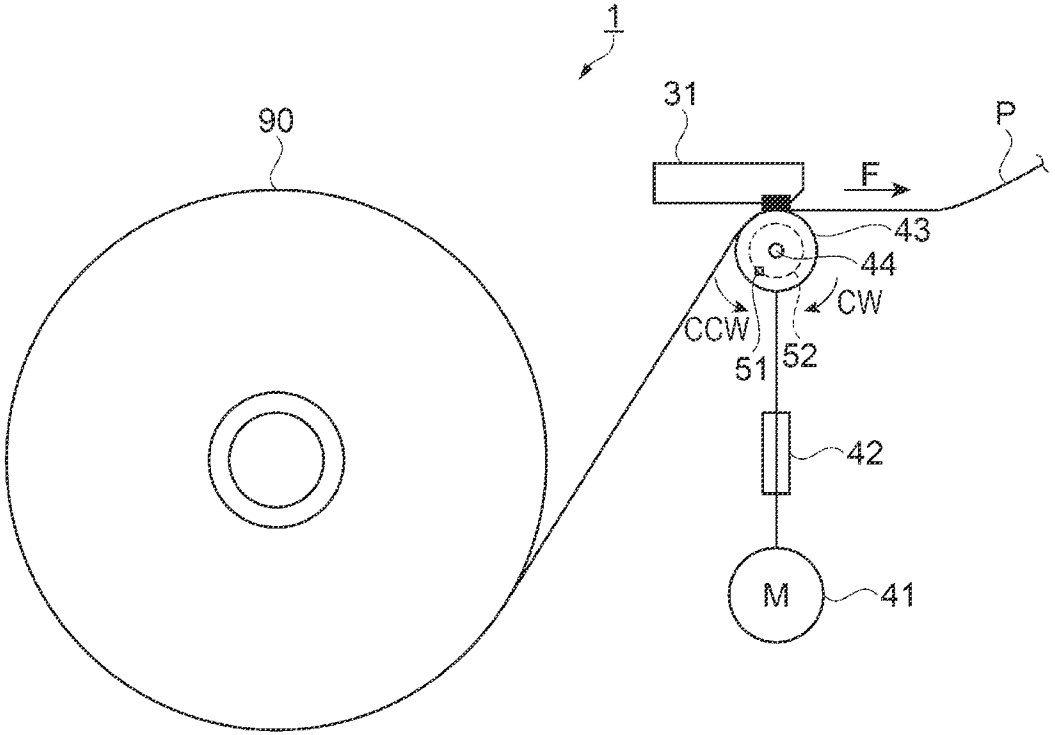
FIG. 2 is a cross-sectional view showing a main part of the printing device.

A printing device 1 shown in FIGS. 1 and 2 is, for example, a line thermal printer. As shown in FIG. 1, the printing device 1 has a control unit 10, a storage unit 20, a printing unit 30, a feeder unit 40, and a detection unit 50.

The control unit 10 has a CPU. The CPU is also referred to as a processor. The control unit 10 reads out and executes a program such as firmware stored in the storage unit 20 and thus controls each part of the printing device 1.

The printing unit 30 has a head 31, as shown in FIG. 2. The head 31 is, for example, a line thermal head. The printing unit 30 also has a pressing mechanism for pressing the head 31 toward a roller 43. A recording paper P is a thermal paper. While the head 31 is in contact with the recording paper P by the pressing mechanism, color development on the recording paper P takes place due to heat generation by the head 31 and thus printing is performed. The control unit 10 controls the head 31 to perform printing, based on print data received from an external device. The recording paper P on which printing is performed by the head 31 is cut by a cutter and discharged from a discharge port.

The feeder unit 40 is configured in such a way that a motor 41 rotates under the control of the control unit 10, transmits the rotation thereof to a shaft 44 while reducing the velocity via a gear 42, and thus causes the roller 43 to rotate about the shaft 44 and feed the recording paper P, as shown in FIG. 2. The roller 43 is cylindrically formed of a flexible resin material or the like, such as a rubber, and is fixed to the shaft 44. The roller 43 is arranged at a position opposite the head 31 via the recording paper P and is also referred to as a platen.

The motor 41 is, for example, a DC motor. The control unit 10 takes in a detection signal from the detection unit 50, described later, detects the velocity of the motor 41, and performs PWM (pulse-width modulation) control on the motor 41 to rotate at a predetermined velocity.

The recording paper P is accommodated in the printing device 1 as a paper roll 90 formed by rolling the recording paper P. The roller 43, together with the head 31 opposite the roller 43, nips the recording paper P due to the pressing by the pressing mechanism. When rotating, the roller 43 generates a feeding force F and thus draws out and feeds the recording paper P from the paper roll 90. The direction in which the roller 43 rotates when feeding the recording paper P is a first direction, which is a clockwise CW direction.

The control unit 10 causes the printing unit 30 to print, while causing the feeder unit 40 to feed the recording paper P in the CW direction.

The detection unit 50 is a so-called rotary encoder detecting the rotational position of the shaft 44. The detection unit 50 is an optical encoder formed of a disk 52, which is a scale having slits formed at a predetermined interval, and a transmission-type photosensor 51 detecting the slits in the disk 52, as shown in FIG. 2.

The photosensor 51 is formed of a light-emitting element and a light-receiving element. The light-emitting element and the light-receiving element are arranged at positions sandwiching the disk 52. The disk 52 is attached in such a way as to rotate about the shaft 44. When the motor 41 causes the shaft 44 to rotate, the disk 52 rotates, too. When the position of a slit provided in the disk 52 coincides with a position on the optical path of the light-emitting element, the light passes through the slit and reaches the light-receiving element, and the light-receiving element detects the light. At this point, the light-receiving element generates a predetermined current. Therefore, a detection signal of a high-level voltage can be taken out. Meanwhile, when the positions of the slits do not coincide with a position on the optical path of the light-emitting element, the light is blocked by the disk 52 and the light-receiving element does not detect the light. At this point, the light-receiving element does not generate a predetermined current. Therefore, a detection signal of a low-level voltage can be taken out.

1-2. Control by Control Unit

Figure 3:
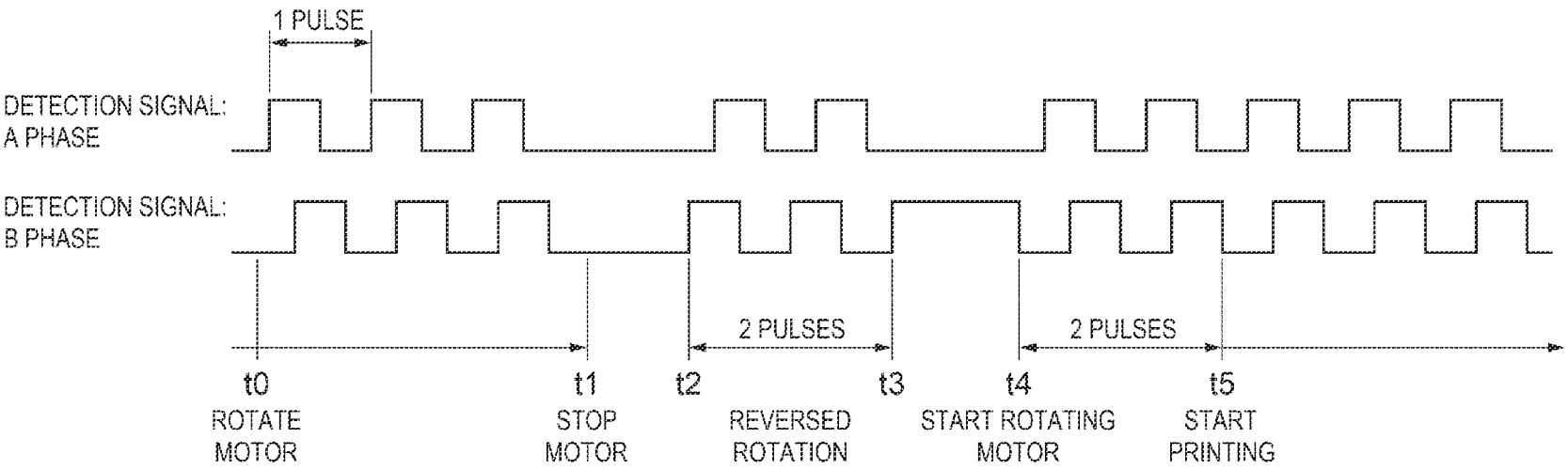
FIG. 3 is a time chart showing control by a control unit.

As shown in FIG. 3, when the voltage of the detection signal outputted from the detection unit 50 is high-level, the photosensor 51 of the detection unit 50 has detected the position of a slit provided in the disk 52. When the voltage of the detection signal is low-level, the photosensor 51 has detected the position of a part of the disk 52 that is not a slit.

As the slits in the disk 52, two sets of slits are provided to have different phases and are configured to be detected separately by the photosensor 51. Therefore, detection signals having A phase and B phase shifted from each other by 90 degrees, that is, shifted from each other by ¼ period, as shown in FIG. 3, are outputted from the detection unit 50 and inputted to the control unit 10.

The control unit 10 can determine whether the direction in which the shaft 44 rotates is the CW direction or a counterclockwise CCW direction, which is the direction opposite to the CW direction, based on the order of the phase displacement of the A phase and the B phase. The CCW direction is a second direction.

The control executed on the feeder unit 40 and the printing unit 30 by the control unit 10, based on the detection signal inputted from the detection unit 50, will now be described, referring to FIG. 3. FIG. 3 shows a detection signal outputted from the detection unit 50 in time series from t0 to t5 representing time.

First, the control at time t0 is described. The control unit 10 controls the feeder unit 40 and causes the motor 41 to rotate the shaft 44 in the CW direction. The detection unit 50 detects the rotation of the shaft 44 and outputs the detection signal.

The detection signal from the detection unit 50 is outputted as a pulse of a predetermined period. A pulse of one period of the detection signal from the detection unit 50 is defined as 1 pulse. The pulse indicates that the shaft 44 is rotating. The number of pulses represents the amount of rotation of the shaft 44.

The control unit 10 causes the roller 43 to rotate in the CW direction via the shaft 44 of the feeder unit 40 and thus feed the recording paper P. At this point, the control unit 10 may control the printing unit 30 to print while feeding the recording paper P.

At time t1, the control unit 10 controls the feeder unit 40 and stops the rotation of the motor 41. As the rotation of the motor 41 is stopped, the rotation of the shaft 44 is stopped, too. Therefore, the detection signal from the detection unit 50 outputs no pulses. At this point, the recording paper P is not fed.

However, at time t2, even though the control unit 10 has stopped the rotation of the motor 41, the detection signal from the detection unit 50 outputs a pulse indicating that the shaft 44 is rotating in the direction opposite to the direction of when the recording paper P is fed. Based on the detection signal from the detection unit 50, the control unit 10 determines that the shaft 44 rotates in the CCW direction by the amount of rotation corresponding to 2 pulses of the detection signal, during a period from time t2 to time t3.

The control unit 10 can determine that the direction in which the shaft 44 rotates is the CCW direction, since the order of the phase displacement of the A phase and the B phase of the detection signal from the detection unit 50 is reversed from when the shaft 44 rotates in the CW direction.

The phenomenon of the shaft 44 rotating in the CCW direction even thought the rotation of the motor 41 is stopped, will now be described.

As described above, the roller 43 of the feeder unit 40 is pressed to the head 31 due to the pressing by the pressing mechanism of the printing unit 30. The roller 43 is formed of a flexible resin material or the like, such as a rubber.

At time t0, the roller 43 of the feeder unit 40 rotates in the CW direction with the rotation of the shaft 44 while being pressed to the head 31 due to the pressing by the pressing mechanism of the printing unit 30, and thus nips and feeds the recording paper P together with the head 31. At this point, due to the flexibility of the roller 43, the roller 43 torsionally flexes and is deformed in the CW direction, which is the direction of the feeding force F, in relation to the shaft 44.

At time t1, when the rotation of the motor 41 is stopped, the feeding force F is no longer generated. At this point, due to the flexibility of the roller 43, a force of recovering from the torsional flexure, which is a deformation, acts on the shaft 44 and the head 31.

The shaft 44 is coupled to the motor 41 via the gear 42. The head 31 is pressed to the roller 43 by the pressing force of the pressing mechanism of the printing unit 30. A detent torque acting to hold the position of the rotor in the motor 41 is smaller than the pressing force of the pressing mechanism of the printing unit 30. Particularly when the motor 41 is a DC motor, the detent torque is smaller than even the detent torques of other motors such as a step motor.

Therefore, the force of recovering from the torsional flexure of the roller 43 acts to cause the reversed rotation of the shaft 44. Consequently, during the period from time t2 to time t3, the shaft 44 rotates in the CCW direction, which is the direction of the reaction force to the force of torsional flexure in the CW direction generated in the roller 43.

The time period from time t1, when the rotation of the motor 41 stops, to time t2, when the shaft 44 starts the reversed rotation, is approximately 100 milliseconds. The phenomenon of the reversed rotation of the shaft 44 due to the flexibility of the roller 43 even though the rotation of the motor 41 is stopped, occurs during a very short time period after the roller 43 is used to feed the recording paper P.

In this example, as shown in FIG. 3, during the period from time t2 to time t3, the detection signal indicates that the shaft 44 is rotating in the CCW direction by the amount of rotation corresponding to 2 pulses. The amount of rotation corresponding to 2 pulses represents the amount of deformation due to the torsional flexure of the roller 43. The amount of deformation of the roller 43 is influenced by the load and the feeding speed at the time of feeding. Therefore, when the paper roll 90 has a larger diameter and the inertia at the time of feeding is greater, or when the feeding speed is higher, the amount of deformation of the roller 43 is greater and the shaft 44 may rotate in the reverse direction by 2 pulses or more.

A case where the control unit 10 starts the printing at time t4 in FIG. 3 will now be described.

On receiving print data from an external device, the control unit 10 is supposed to cause the printing unit 30 to print while causing the feeder unit 40 to feed the recording paper P in the CW direction.

At this point, when the control unit 10 starts to rotate the motor 41 of the feeder unit 40, the rotation is transmitted to the shaft 44. However, when the shaft 44 starts to rotate, the roller 43, due to the flexibility thereof, torsionally flexes in the CW direction, which is the direction of the feeding force F, in relation to the shaft 44 and is thus deformed. In this case, the period when the roller 43 is deformed by the torsional flexure is equivalent to the amount of rotation corresponding to 2 pulses of the detection signal, as described above. From the third pulse of the detection signal onward, the roller 43 rotates at last.

In this way, with the rotation of the motor 41, the shaft 44 rotates in the CW direction by the amount of rotation corresponding to 2 pulses. However, in the roller 43, the torque, that is, the rotational force, generated at this point is used for the deformation due to the torsional flexure of the roller 43, and the roller 43 itself does not rotate. Since the roller 43 does not rotate in the CW direction during the period of the first 2 pulses of the detection signal, the feeding force F is not generated and the recording paper P is not fed.

The control unit 10 causes the printing unit 30 to start to print data at the same when causing the feeder unit 40 to start to feed the recording paper P in the CW direction. Therefore, the control unit 10 causes the printing unit 30 to print on the recording paper P even during the period of the 2 pulses of the detection signal. However, since the recording paper P is not fed in the CW direction, the result of printing may be deteriorated by being jammed or crushed.

From the third pulse of the detection signal onward, the roller 43 starts to rotate in the CW direction at last with the rotation of the shaft 44 and therefore generates the feeding force F and feeds the recording paper P. At this point, the result of printing becomes normal at last.

Thus, in this embodiment, in order to improve the result of printing at the start of printing, the control unit 10 causes the motor 41 of the feeder unit 40 to rotate the shaft 44 in advance in the CW direction by the amount of rotation corresponding to 2 pulses of the detection signal, during a period from time t4 to time t5 and before time t5 when the printing unit 30 starts to print, as shown in FIG. 3.

Specifically, when the control unit 10 receives print data from the external device and is about to start the printing, the control unit 10 causes the motor 41 to start to rotate the shaft 44 in the CW direction at time t4 and causes the shaft 44 to rotate by the amount of rotation corresponding to 2 pulses of the detection signal by time t5 before causing the printing unit 30 to start to print, and then causes the printing unit 30 to start to print at time t5.

During the period from time t4 to time t5 before the printing unit 30 starts to print on the recording paper P, the control unit 10 causes the motor 41 to rotate the shaft 44 in the CW direction by the amount of rotation corresponding to 2 pulses of the detection signal. During this time, the deformation due to the torsional flexure of the roller 43 ends. From time t5 onward, the roller 43 rotates normally and therefore generates the feeding force F and feeds the recording paper P normally in the CW direction.

The control unit 10 causes the printing unit 30 to start to print at time t5, at which point the recording paper P starts to be fed normally in the CW direction. Therefore, the result of printing is not jammed or crushed and can thus be improved.

1-3. Resolution of Head and Detection Signal

In an example, in the detection unit 50, the resolution of the detection signal is set to 1440 pulses per inch. That is, the detection unit 50 is set in such a way that 1 pulse of the detection signal is outputted from the detection unit 50 every time the recording paper P is fed by the length of 1/1440 inch by the feeder unit 40. Meanwhile, in an example, the resolution of the head 31 is 180 dpi (dots per inch), that is, 1 dot every 1/180 inch. When the recording paper P is fed by the feeder unit 40 by the same length of 1/180 inch as the resolution of the head 31, 8 pulses of the detection signal are outputted from the detection unit 50.

Therefore, the control unit 10 controls the head 31 to print 1 dot on the recording paper P in such a timing as to drive 1 dot during a period when the 8 pulses of the detection signal are inputted thereto from the detection unit 50.

As described above, the control unit 10 causes the motor 41 to rotate the shaft 44 in the CW direction by the amount of rotation corresponding to 2 pulses of the detection signal, before causing the printing unit 30 to start to print. Since the resolution of the detection signal from the detection unit 50 is 1440 pulses per inch and the resolution of the head 31 is 1 dot every 1/180 inch, the amount of rotation corresponding to 2 pulses of the detection signal is equivalent to 1/4 of the resolution of the head 31 of 1 dot every 1/180 inch.

In this way, the amount of rotation corresponding to 2 pulses of the detection signal, that is, the amount by which the motor 41 rotates the shaft 44 in the CW direction before the printing unit 30 starts to print, is the amount of rotation based on the resolution of the head 31 of 1 dot every 1/180 inch. In this example, the amount of rotation by which the shaft 44 is rotated in the CW direction before printing, is the value of the resolution of the head 31 divided by an integer. The amount of rotation may be an integral multiple of the resolution of the head 31. Each of these values may be an approximate value.

As the slits in the disk 52, two sets of slits are provided to have different phases and are configured to be detected separately by the photosensor 51. Therefore, detection signals having A phase and B phase shifted from each other by 90 degrees, that is, shifted from each other by 1/4 period, as shown in FIG. 3, are outputted from the detection unit 50 and inputted to the control unit 10.

The control unit 10 can adjust the detection signals of A phase and B phase to various resolutions of the head 31 by frequency division, multiplication, combination or the like.

In this way, the amount of rotation corresponding to the detection signal, that is, the amount by which the motor 41 rotates the shaft 44 in the CW direction before the printing unit 30 starts to print, can be based on the resolution of the detection signal from the detection unit 50 and can be based on the resolution of the head 31.

The foregoing embodiment can achieve the effects described below.

The printing device 1 according to an embodiment includes: the printing unit 30 printing on recording paper P; the feeder unit 40 that has the roller 43 rotating in the CW direction, which is the first direction, about the shaft 44, and feeding the recording paper P, and the motor 41 rotating the shaft 44; the detection unit 50 detecting a rotation of the shaft 44 in the first direction and a rotation thereof in the second direction, which is the CCW direction opposite to the first direction; and the control unit 10 controlling the feeder unit 40, based on the rotation of the shaft 44 detected by the detection unit 50. The control unit 10 causes the motor 41 of the feeder unit 40 to rotate the shaft 44 in the first direction and then stop the shaft 44, and subsequently causes the motor 41 to rotate the shaft 44 in the first direction before the printing unit 30 prints, based on the rotation of the shaft 44 in the second direction detected by the detection unit 50.

The roller 43 feeding the recording paper P is flexible. Therefore, the roller 43 is deformed when the shaft 44 of the roller 43 is rotated in the first direction, which is the direction of feeding the recording paper P. When the shaft 44 is stopped after the recording paper P is fed, the roller 43 recovering from the deformation generates a force in the second direction opposite to the first direction. Consequently, the shaft 44 rotates in the second direction. When the shaft 44 of the roller 43 is rotated in the first direction again, the roller 43 takes this rotation for deformation due to the previous rotation of the shaft 44 in the second direction and cannot feed the recording paper P. During this time, even when the printing unit 30 prints on the recording paper P, the recording paper P is not fed and therefore the result of printing is jammed or crushed, posing a risk of deterioration in the print quality.

To cope with this, according to the above configuration, the control unit 10 causes the shaft 44 to rotate in the first direction, based on the rotation of the roller 43 in the second direction, before the printing unit 30 prints. The control unit 10 thus enables printing in the state where the recording paper P is actually fed. Therefore, the print quality can be improved.

Since the roller 43 is deformed at the start of rotation and after rotation, the detection unit 50 is configured to detect the rotation of the shaft 44, not of the roller 43.

In the printing device 1 according to an embodiment, the head 31 of the printing unit 30 is a line thermal head. The motor is a DC motor. The detection unit 50 includes an encoder detecting the rotation of the shaft 44.

According to the above configuration, a line thermal head is applied as the head 31 of the printing unit 30. Therefore, the printing unit 30 can print while the roller 43 feeds the recording paper P. As the motor 41, a DC motor with a relatively small torque can be applied. As the detection unit 50, an encoder detecting the rotation of the shaft 44 can be applied.

In the printing device 1 according to an embodiment, the amount by which the motor 41 rotates the shaft 44 in the first direction before the printing unit 30 prints, is based on the resolution of the line thermal head of the printing unit 30.

According to the above configuration, the amount of rotation corresponding to the detection signal from the detection unit 50, that is, the amount by which the motor 41 rotates the shaft 44 in the first direction before the printing unit 30 starts to print, can be based on the resolution of the detection signal from the detection unit 50 and can be based on the resolution of the head 31.

These embodiments have been described in detail, referring to the drawings. However, the specific configurations in these embodiments are not limiting. Various modifications, replacements, deletions and the like can be made without departing from the spirit and scope of the present disclosure.

For example, while the printing device 1 is described using an example where the head 31 is a line thermal head, the type of the head 31 is not particularly limited. For example, an inkjet head may be employed.

Also, while an example where the motor 41 is a DC motor is described, other types of motors such as a step motor may be employed.

Also, while an example where the detection unit 50 is an encoder is described, other detection systems such as a tachogenerator may be employed.

Also, while the recording paper P is described as being rolled as the paper roll 90, a cut paper of A4 size or the like may be employed.

Moreover, while an example where the disk 52 of the detection unit 50 is attached to the shaft 44 is described, the disk 52 may be attached to the shaft of the gear 42 or the shaft of the motor 41, provided that the detection unit 50 can directly or indirectly detect the rotational position of the shaft 44.

What is claimed is:

1. A printing device, comprising:

a printing unit printing on a recording paper;

a feeder unit that has a roller rotating in a first direction about a shaft and feeding the recording paper, and a motor rotating the shaft;

a detection unit configured to:

detect a rotation of the shaft in the first direction; and detect a rotation of the shaft in a second direction opposite to the first direction; and a control unit configured to:

control the feeder unit based on the detected rotation of the shaft;

control the motor of the feeder unit to rotate the shaft in the first direction;

control, after the rotation of the shaft in the first direction, the motor to stop the rotation of the shaft, wherein the stoppage of the rotation of the shaft causes the shaft to rotate in the second direction; and control the motor to rotate the shaft in the first direction, before the printing unit prints, based on the rotation of the shaft in the second direction.

2. The printing device according to claim 1, wherein the printing unit has a line thermal head, the motor is a DC motor, and the detection unit includes an encoder detecting the rotation of the shaft.

3. The printing device according to claim 2, wherein an amount by which the motor rotates the shaft in the first direction before the printing unit prints, is based on a resolution of the line thermal head.

4. A control method for a printing device, the printing device comprising: a printing unit printing on a recording paper; a feeder unit that has a roller rotating in a first direction about a shaft and feeding the recording paper, and a motor rotating the shaft; and a detection unit detecting a rotation of the shaft in the first direction and a rotation thereof in a second direction opposite to the first direction, the control method comprising:

controlling the motor of the feeder unit to rotate the shaft in the first direction;

controlling, after the rotation of the shaft in the first direction, the motor to stop the rotation of the shaft, wherein the stoppage of the rotation of the shaft causes the shaft to rotate in the second direction; and controlling the motor to rotate the shaft in the first direction, before the printing unit prints, based on the rotation of the shaft in the second direction.

* * * * *